US007036283B2

(12) United States Patent
Halas

(10) Patent No.: US 7,036,283 B2
(45) Date of Patent: May 2, 2006

(54) CORNER MOLDING CAP SYSTEM

(76) Inventor: Paul Halas, 3 Brainerd Dr., Cranbury, NJ (US) 08512-3128

( * ) Notice: Subject to any disclaimer, the term of this patent is extended or adjusted under 35 U.S.C. 154(b) by 188 days.

(21) Appl. No.: 10/756,714

(22) Filed: Jan. 13, 2004

(65) Prior Publication Data

US 2005/0166528 A1 Aug. 4, 2005

(51) Int. Cl.
*E04C 2/38* (2006.01)
*E04F 19/00* (2006.01)

(52) U.S. Cl. ..... 52/311.1; 52/656.1; 52/716.1; 52/717.01; 52/718.01; 52/656.2; 52/656.4; 52/656.5; 52/656.9

(58) Field of Classification Search ..... 52/311.1, 52/656.1, 716.1, 717.01, 717.02, 718.01, 52/656.2, 656.4, 656.5, 656.9
See application file for complete search history.

(56) References Cited

U.S. PATENT DOCUMENTS 2,733,788 A * 2/1956 Farmer ..... 403/295
4,024,691 A * 5/1977 Hansen et al. ..... 52/656.9
4,094,112 A 6/1978 Smith et al.
4,147,005 A 4/1979 Meyer
4,534,147 A 8/1985 Cristell
5,001,877 A 3/1991 Edwards
5,450,702 A * 9/1995 Barnett ..... 52/656.2
5,547,011 A * 8/1996 Dotson et al. ..... 160/381
5,794,399 A * 8/1998 Searer ..... 52/718.01
5,884,444 A 3/1999 Harris
5,921,056 A * 7/1999 Weiss et al. ..... 52/745.16
5,953,881 A 9/1999 Sherry
5,966,891 A * 10/1999 Fagan et al. ..... 52/656.9
6,112,481 A 9/2000 Schiedegger et al.
6,212,835 B1 4/2001 Schiedegger et al.
6,276,101 B1 8/2001 Schiedegger et al.
6,363,673 B1 * 4/2002 Robertson ..... 52/255
6,381,915 B1 * 5/2002 Wood ..... 52/718.06
6,385,927 B1 * 5/2002 Schiedegger et al. ..... 52/211
6,393,779 B1 * 5/2002 Boldt ..... 52/210
6,474,038 B1 * 11/2002 Nien et al. ..... 52/717.01
6,550,192 B1 * 4/2003 Nelson et al. ..... 52/177
6,553,732 B1 * 4/2003 Shaw ..... 52/287.1
6,647,677 B1 * 11/2003 Berger, Jr. ..... 52/204.1
6,745,523 B1 * 6/2004 Petta ..... 52/213

FOREIGN PATENT DOCUMENTS

GB 996639 5/1963

* cited by examiner

*Primary Examiner*—Jeanette E. Chapman
(74) *Attorney, Agent, or Firm*—Mathews, Shepherd, McKay & Bruneau, P.A.

(57) ABSTRACT

A molding cap for use with a first molding having a first cross-sectional area and a second molding having a second cross-sectional area, is a three-dimensional structure with a top surface, a bottom surface and a side surface. The side surface has a first hollow area and a second hollow area corresponding to the second cross-sectional area of molding. A first molding and a second molding are partially covered by the three-dimensional structure as the three-dimensional structure straddles the first molding and straddles the second molding, such that said three-dimensional structure conceals an end of the first molding and an end of the second molding and any joint between the ends.

18 Claims, 6 Drawing Sheets

CORNER MOLDING CAP SYSTEM

FIELD OF THE INVENTION

This invention relates to decorative moldings.

BACKGROUND OF THE INVENTION

Moldings are used to enhance the appearance of wall openings and to protect the wall surface near the opening for doors and windows. Traditionally, the moldings that form the corners of the openings require accurate, time-consuming Mitered cuts to present a quality appearance. Unfortunately, structural settling as well as expansion and shrinkage of the molding caused by moisture changes, heat changes, etc. result in the mitered joints pulling apart and gaps appearing.

Some openings utilize fancy decorative trim moldings which often include corner sections, which require more mitered cuts and thus expose more joints to gap appearance. In order to upgrade an existing 45 degree opening molding requires the removal of the existing molding, careful mitered cuts and installation of the corner block molding along with the reinstallation of the re-cut molding.

Therefore there is a need for a molding system, which can eliminate the need for mitered cuts, hide gaps in joints caused by expansion/shrinkage, can be easily installed with new molding trim as well as retrofitted to an existing trimmed opening.

SUMMARY OF THE INVENTION

In one aspect, the present invention is a molding cap for use with a first molding having a first cross-sectional area and a second molding having a second cross-sectional area. The molding cap is a three-dimensional structure with a top surface, a bottom surface and a side surface. The side surface has a first hollow area and a second hollow area corresponding to the second cross-sectional area of molding. A first molding and a second molding are partially covered by the three-dimensional structure as the three-dimensional structure straddles the first molding and straddles the second molding, such that said three-dimensional structure conceals an end of the first molding and an end of the second molding and any joint between the ends.

BRIEF DESCRIPTION OF THE DRAWINGS

A more complete understanding of the present invention may be obtained from consideration of the following description in conjunction with the drawings in which.

DETAILED DESCRIPTION OF ILLUSTRATIVE EMBODIMENTS

Although the present invention, corner molding cap system is particularly well suited for use with a doorway and will be so described herein, it is equally well suited for use with other wall openings, including but not limited to windows, pass troughs, nooks, etc.

Trimming a doorway with molding (casing) has a strong impact on the overall style, appearance, and proportion of the opening as well as the overall style of the building's interior. Furthermore, the casing is practical in concealing the gap between the doorframe (jamb) and the rough opening and helps to hold the frame in the opening.

Figure 1A:
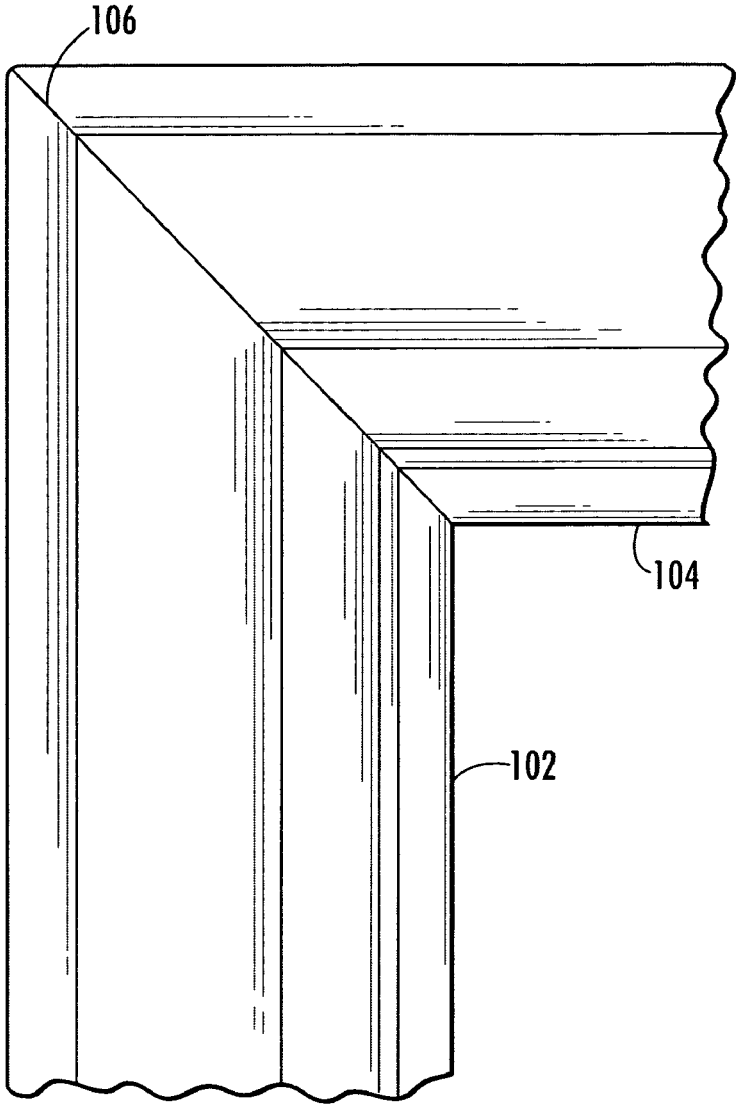
FIG. 1*a* is a partial view of a door molding with 45 degree mitered corners.

Casing can be relatively plain, such as the popular clamshell design or square-edge design, or detailed, such as colonial-style molding. The most common casing joint design is the mitered picture-frame casing or 45 degree mitered corner shown in FIG. 1*a*.

When the molding is installed, it is not unusual for the miter joint to meet with a gap, which can happen if the jamb is not square or if it sits slightly below or above the plane of the wall, the casing miter may need re-cutting from a new piece of molding, since cutting will result in the casing being slightly short.

Figure 1B:
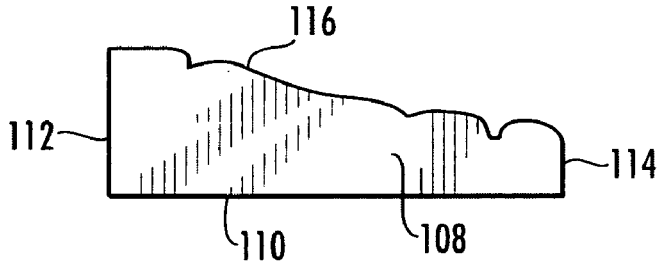
FIG. 1*b* is a cross-sectional view of the door molding

Referring back to FIG. 1*a* as well as to FIG. 1*b*, there is shown a is a partial view of a door molding with 45 degree mitered corners, which is also known as a mitered picture-frame casing. Moldings 102, 104 are joined at a 45 degree mitered corner 106. FIG. 1*b* is a cross-sectional view of door molding shown in FIG. 1*a*. Molding 102, 104 has a cross-section 108 which is defined by bottom 110 which is adjacent to the wall surface, sides 112 and 114 and contoured top molding surface 116.

Figure 2:
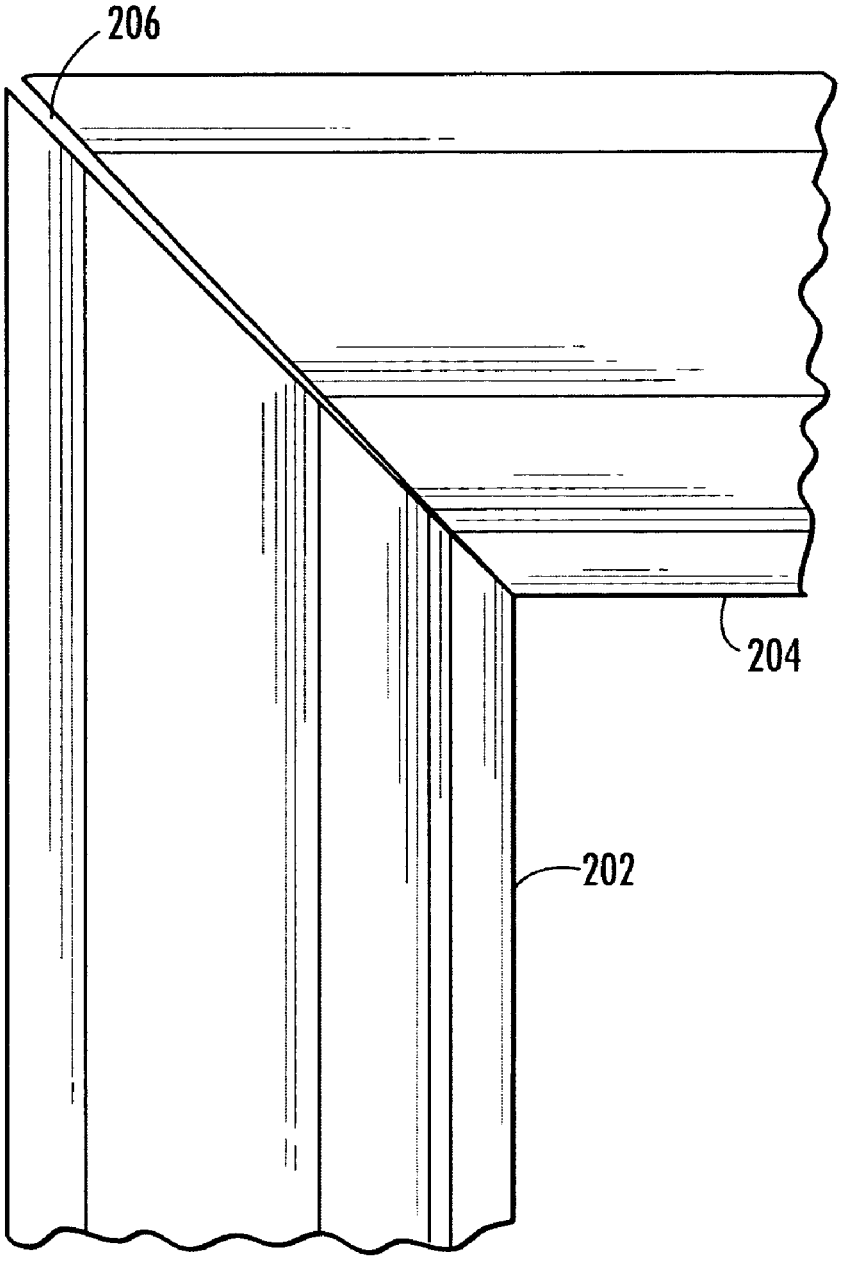
FIG. 2 is a partial view of a door molding with 45 degree mitered corners having a gap.

Referring to FIG. 2 there is shown a partial view of a door molding with 45 degree mitered corners having a gap. Moldings 202 and 204 were mitered to provide a close fit. Unfortunately, structural settling as well as expansion and shrinkage of the molding caused by moisture changes, heat changes, etc. results in the mitered joint pulling apart and a gap 206 appearing at the mitered joint. In order to repair the gap, the moldings 202 and 204 must be replaced however this will not prevent the reappearance of a gap 206 in the future.

Figure 3:
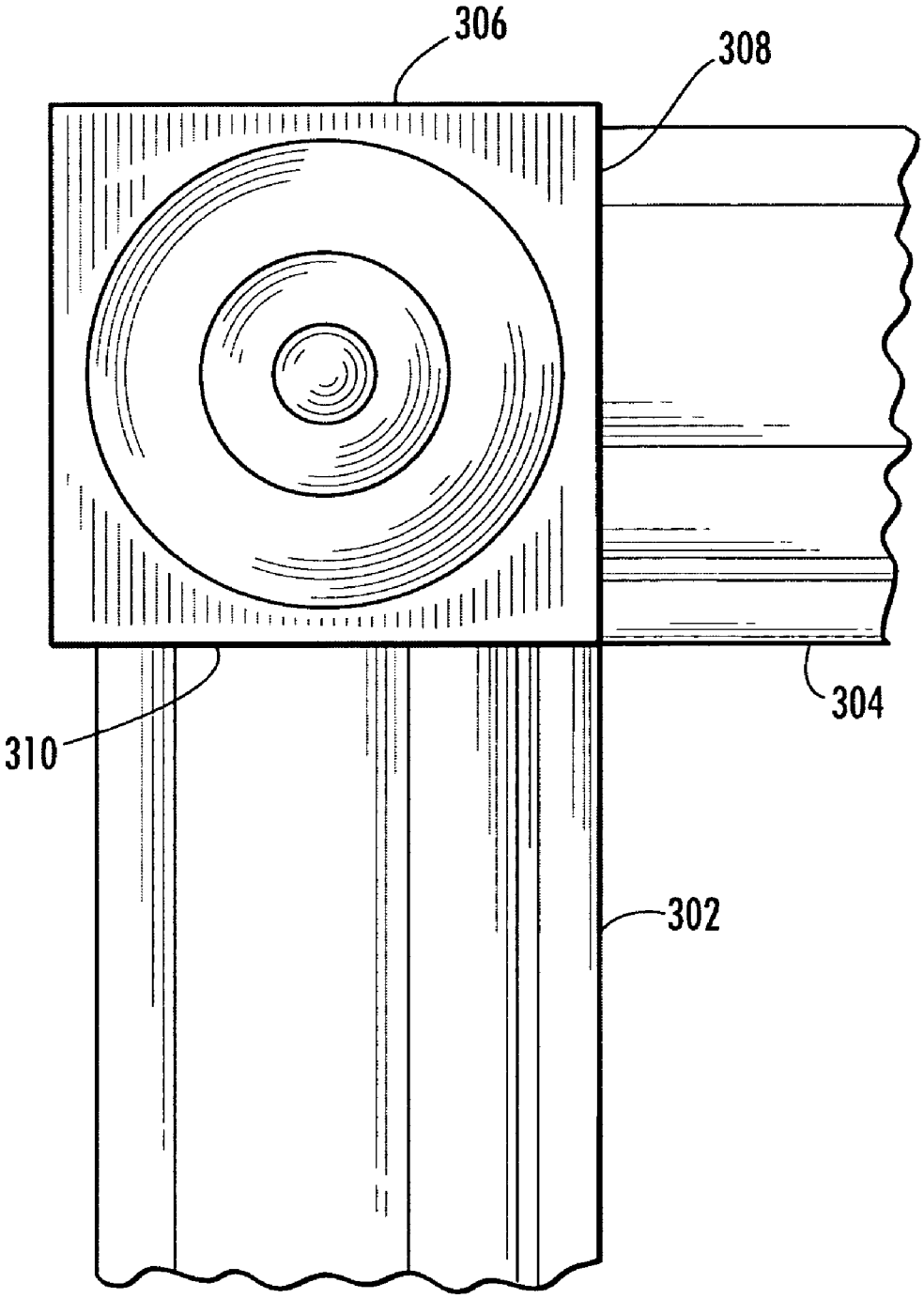
FIG. 3 is a partial view of a door molding with 90 degree mitered corners and a decorative corner molding.

Referring to FIG. 3 there is shown a partial view of a door molding with 90 degree mitered corners and a decorative corner molding. While this joint is less common than the picture frame 45 degree mitered cut joint, it is popular in expensive construction and restoration. The decorative corner molding was more common in construction a century or more ago, when labor was not as expensive as today. Moldings 302 and 304 have a 90 degree mitered cut which abuts to carved decorative corner molding 306 at two mitered joints 308 and 310. Unfortunately, structural settling as well as expansion and shrinkage of the molding caused by moisture changes, heat changes, etc. results in the mitered joints 308 and 310 pulling apart and a gap appearing (not shown).

Figure 4:
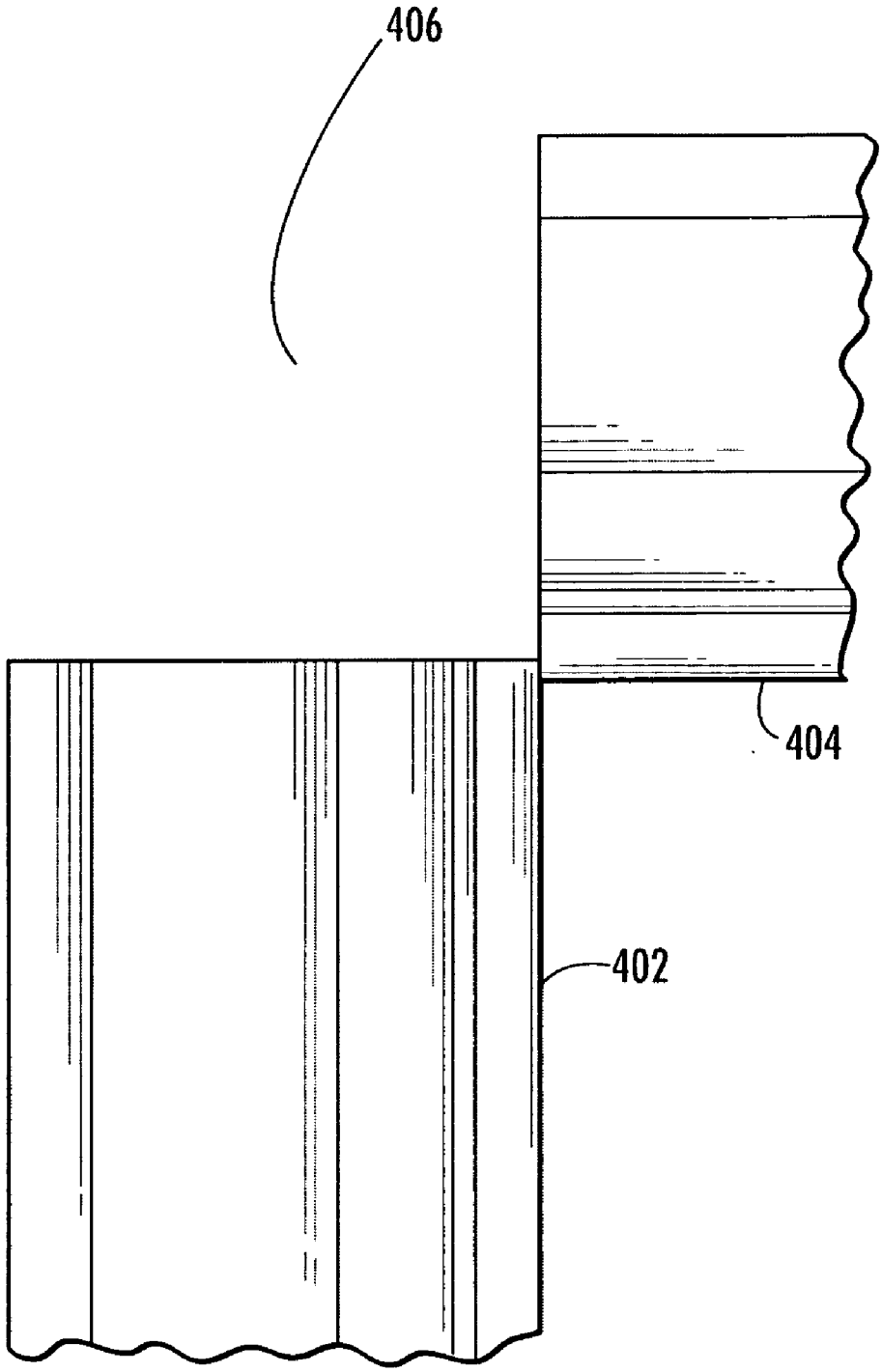
FIG. 4 is a partial view of a door molding with un-mitered corners and a large gap.

Referring to FIG. 4 there is shown a partial view of a door molding with un-mitered corners and a large gap. Moldings 402 and 404 could have been previously mitered as shown in FIG. 3 and the decorative corner molding 306 have been damaged or lost. Alternatively, the moldings 402 and 404 may have been rough-cut. In either case, gap 406 appears at the corner of the door molding.

Figure 5:
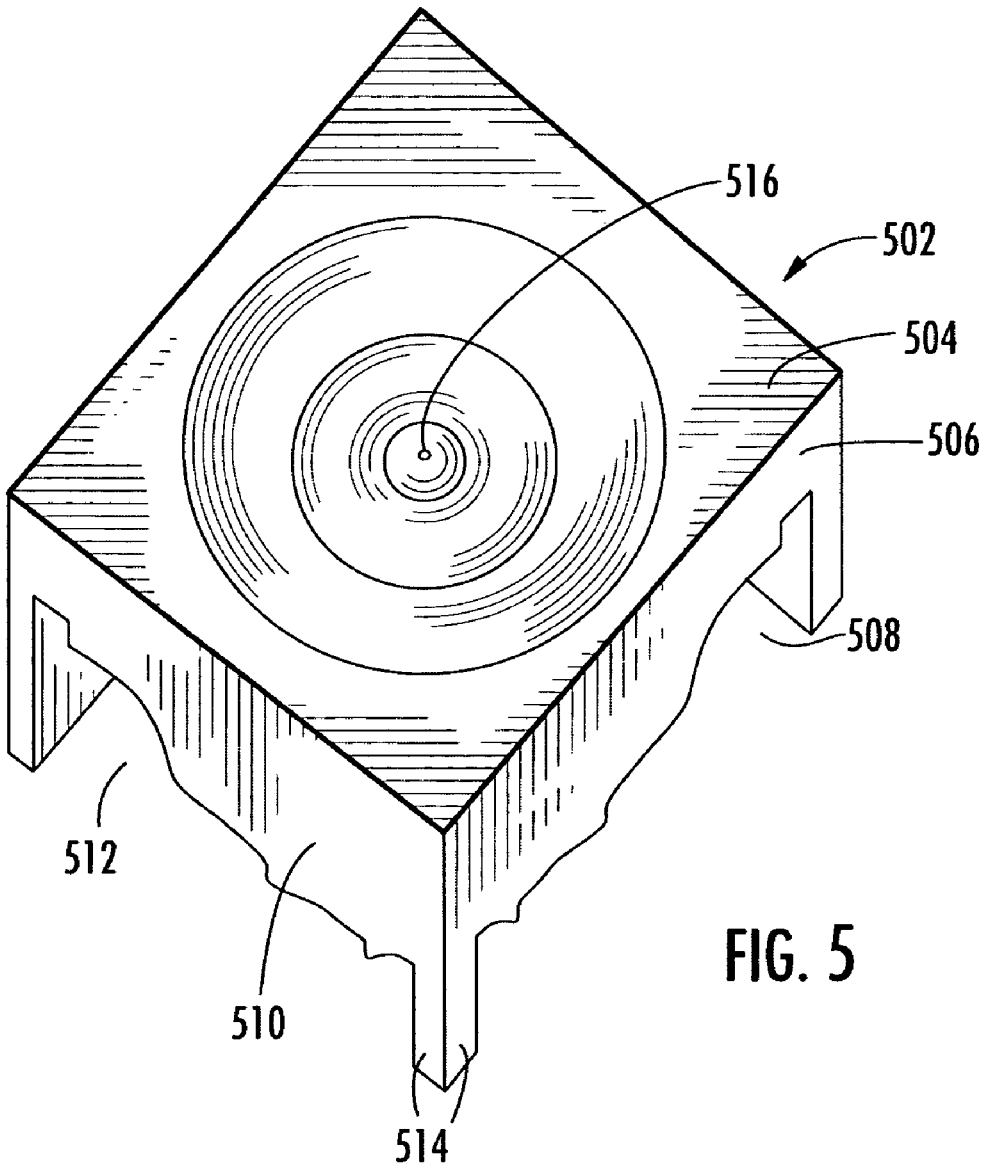
FIG. 5 is a perspective view of the present invention corner molding system; and, FIG. 6 is a partial view of a door molding with the present invention corner molding system installed.

FIG. 5 is a perspective view of the present invention corner molding system. The corner molding system 502 is cleverly constructed to eliminate the need for mitered corners as well as prevents gaps from appearing at the corner joint. The corner molding system 502 has a front decorative surface 504, four sides, two of which are hidden from view (outer sides), and a partially hollow bottom. The two sides that are hidden from view are essentially typical solid smooth surfaces, although in some embodiments they may have grooves or other decorative elements on them. Two sides 506 and 510 (inner sides) are shown. Sides 506 and 510 have corresponding hollow portions 508 and 512. A pilot hole 516 is provided in or near the center of the corner molding system. The pilot hole 516 permits a nail, capped decorative nail, or other suitable fasteners to be inserted to secure the corner molding system 502 over the moldings.

The hollow portions 508 and 512 are specially made such that they correspond to the molding cross section 108 shown in FIG. 1*b*. When the molding cross section 108 is symmetrical, the hollow portions 508 and 512 will have the same profiles. When the molding cross section 108 is asymmetrical, one of the hollow portions 508 and 512 will have a mirror profile of the other hollow portion. Corner molding system 502 has extended portions 514 which enable the corner molding system 502 to straddle the moldings.

Figure 6:
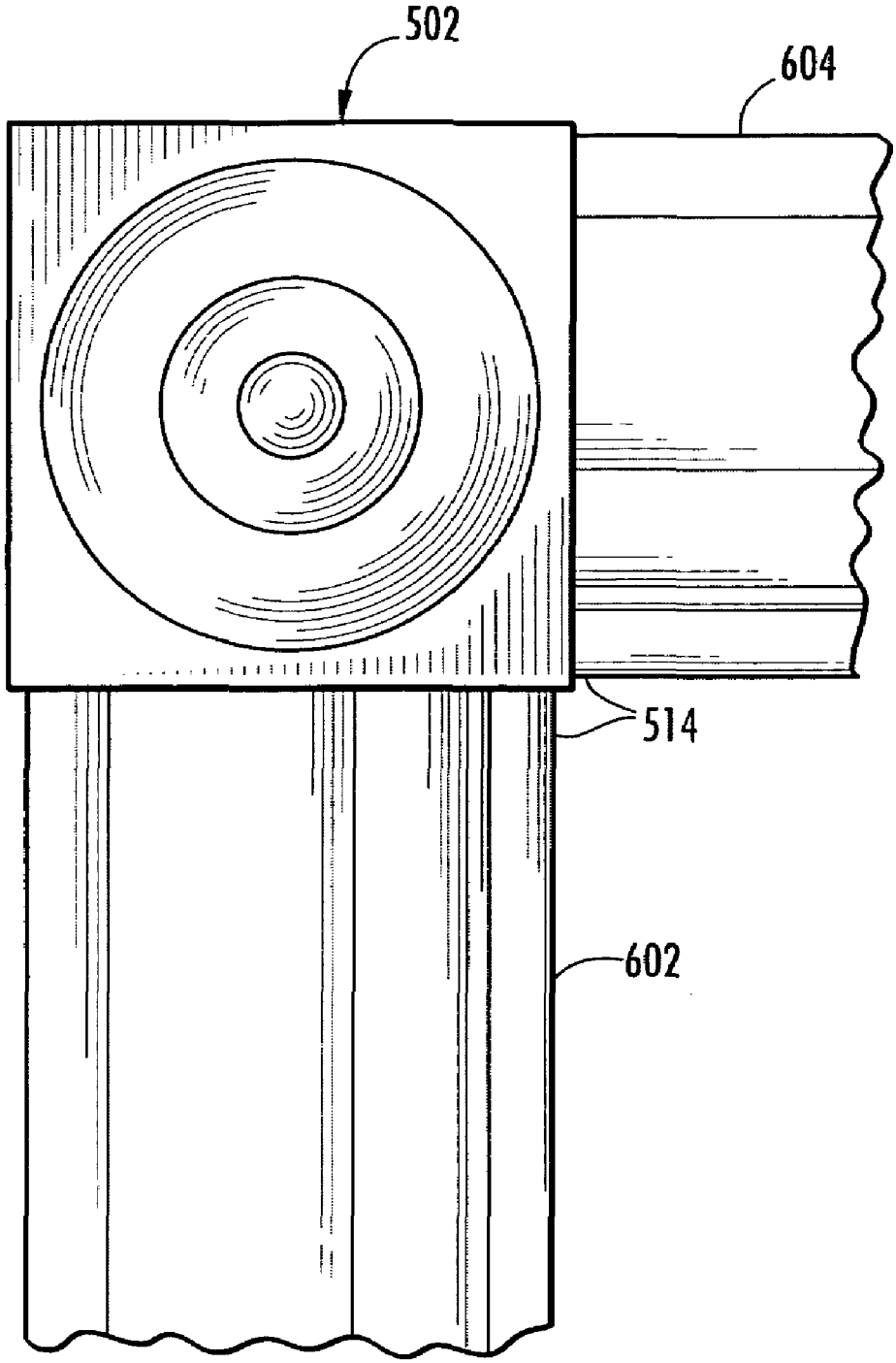

Referring to FIG. 6 there is shown a partial view of a door molding with the present invention corner molding system installed. Extended portions 514 enable the corner molding system 502 to straddle the moldings 602 and 604. By attaching the corner molding system 502 to the wall or other structure rather than directly to the moldings 602 and 604, structural settling as well as expansion and shrinkage of the molding caused by moisture changes, heat changes, etc. results in not result in a gap appearing in the molding. By having the corner molding system 502 to straddle the moldings 602 and 604, the moldings 602 and 604 can slide within hollow portions 508 and 512.

The corner molding system 502 can be installed over an existing mitered corner such as shown in FIGS. 1 and 2, as well as installed over a door molding with un-mitered corners and/or a large gap as shown in FIG. 4. This enables the corner molding system to be used as an add on/upgrade to existing moldings to enhance the appearance and/or to hide flaws in the construction or problems that have developed. Because the corner molding 502 system eliminates the need for mitering corners, the installation time for trimming a doorway is significantly reduced, errors in cutting almost eliminated, and complexity of the project reduced. Thus enabling do it yourselfers to easily achieve professional carpentry results without needing the expertise or requiring the effort.

The corner molding system 502 can be extruded, cast or molded from a variety of materials including but not limited to plastics, resins and other materials. In one embodiment of the present invention, the corner molding system 502 can be made from wood where the hollow portions 508 and 512 are grooved or routed out. This can be done with a cutting blade that is a complementary match (opposite) to a cutting blade used to grove moldings 602 and 604.

By offering the corner molding system 502 along with the corresponding moldings 602 and 604 a system for simplified finishing of doorway trims is available to the homeowner as well as the contractor. By offering the corner molding system 502 with hollows portions 508 and 512 for corresponding moldings 602 and 604, a repair kit/upgrade kit is available to the homeowner as well as the contractor.

In view of the foregoing description, numerous modifications and alternative embodiments of the invention will be apparent to those skilled in the art. Accordingly, this description is to be construed as illustrative only and is for the purpose of teaching those skilled in the art the best mode of carrying out the invention. Details of the structure, including but not limited to particular geometrical shape of the corner molding system as well as the angle of the corner may be varied substantially without departing from the spirit of the invention, and the exclusive use of all modifications, which come within the scope of the appended claim, is reserved. In particular, by changing the angle at which the molding enters the hollow portion and suitably modifying the hollow portions in view of this, a corner molding system can be provided for three sided, five sided, six sided, seven sided, etc. openings in addition to the four sided rectangular openings described herein.

I claim:

1. A molding cap for use with a first molding having a first cross-sectional area and a proximal end, and a second molding having a second cross-sectional area and a proximal end, the molding cap comprising:

a three-dimensional structure, said three-dimensional structure further comprising:

a front surface;

a top side surface generally perpendicular to said front surface;

an outer side surface generally perpendicular to said front surface;

a bottom side surface generally perpendicular to said front surface;

an inner side surface generally perpendicular to said front surface;

said bottom side surface having a first hollow area corresponding to the first cross-sectional area and said inner side surface having a second hollow area corresponding to the second cross-sectional area;

wherein the first molding is partially covered by said three-dimensional structure and the second molding is partially covered by said three-dimensional structure, as said three-dimensional structure straddles the first molding and straddles the second molding, such that said three-dimensional structure conceals the proximal end of the first molding and the proximal end of the second molding.

2. The molding cap as recited in claim 1 wherein said top side surface and said outer side surface are mostly flat solid surfaces.

3. The molding cap as recited in claim 1 wherein said first hollow area is orientated approximately ninety degrees relative to said second hollow area.

4. The molding cap as recited in claim 1 wherein said first hollow area is orientated at an obtuse angle relative to said second hollow area.

5. The molding cap as recited in claim 1 wherein said front surface has a pilot hole for a fastener to secure said three-dimensional structure.

6. The molding cap as recited in claim 1 wherein said front surface further comprises a three-dimensional decorative surface.

7. The molding cap as recited in claim 1 wherein said three-dimensional structure is secured such that the first molding is permitted to slide within the first hollow area and the second molding is permitted to slide within the second hollow area.

8. The molding cap as recited in claim 1 wherein said first hollow area and said second hollow area define mirrored areas.

9. The molding cap as recited in claim 1 wherein said first hollow area and said second hollow area which extend into said three-dimensional structure are at least as large as the corresponding area defined at the side surface.

10. A molding and molding cap system comprising:

a first molding having a first cross-sectional area and a proximal end;

a second molding having a second cross-sectional area and a proximal end;

a three-dimensional structure, said three-dimensional structure further comprising:

a front surface;

a top side surface generally perpendicular to said front surface;

an outer side surface generally perpendicular to said front surface;

a bottom side surface generally perpendicular to said front surface;

an inner side surface generally perpendicular to said front surface;

said bottom side surface having a first hollow area corresponding to said cross-sectional area and said inner side surface having a second hollow area corresponding to a second cross-sectional area;

wherein the first molding is partially covered by said three-dimensional structure and the second molding is partially covered by said three-dimensional structure, said three-dimensional structure straddles said said first molding and straddles said second molding, such that said three-dimensional structure conceals the proximal end of said said first molding and said proximal end of said second molding.

11. The system as recited in claim 10 wherein said top side surface and said outer side surface are mostly flat solid surfaces.

12. The system as recited in claim 10 wherein said first hollow area is orientated approximately ninety degrees relative to said second hollow area.

13. The system as recited in claim 10 wherein said first hollow area is orientated at an obtuse angle relative to said second hollow area.

14. The system as recited in claim 10 wherein said top surface has a pilot hole for a fastener to secure said three-dimensional structure.

15. The system as recited in claim 10 wherein said front surface further comprises a three-dimensional decorative surface.

16. The system as recited in claim 10 wherein said three-dimensional structure is secured such that said at least one molding is permitted to slide within the first hollow area.

17. The system as recited in claim 10 wherein said first hollow area and said second hollow area define mirrored areas.

18. The system as recited in claim 10 wherein said first hollow area and said second hollow area which extend into said three-dimensional structure are at least as large as the corresponding area defined at the side surface.

* * * * *